US005127252A

United States Patent [19]

Lange

[11] Patent Number: 5,127,252

[45] Date of Patent: Jul. 7, 1992

[54] APPARATUS FOR THE WORKING OF WIRE PIECES AND THE USE OF SUCH APPARATUS

[75] Inventor: Gerhard Lange, Reutlingen, Fed. Rep. of Germany

[73] Assignee: WAFIOS Maschinenfabrik GmbH & Co. Kommanditgesellschaft, Fed. Rep. of Germany

[21] Appl. No.: 544,922

[22] Filed: Jun. 28, 1990

[30] Foreign Application Priority Data

Jul. 8, 1989 [DE] Fed. Rep. of Germany ..... 3922532

[51] Int. Cl.[5] ..... B21D 41/02; B21F 5/00; B21G 3/12

[52] U.S. Cl. ..... 72/316; 72/408; 74/567; 470/125

[58] Field of Search ..... 72/306, 316, 318, 408, 72/452; 10/15, 49, 43–48, 50–54; 74/567, 569

[56] References Cited

U.S. PATENT DOCUMENTS

| | | | |
|---|---|---|---|
| 333,863 | 1/1886 | Kimball et al. | 10/45 |
| 346,467 | 8/1886 | Court | 10/48 |
| 1,260,260 | 3/1918 | Harmon | 74/569 |
| 1,642,597 | 9/1927 | Wikschtrom . | |
| 1,739,745 | 12/1929 | Wikschtrom . | |
| 2,381,171 | 8/1945 | Little et al. | 10/49 |

FOREIGN PATENT DOCUMENTS

| | | | |
|---|---|---|---|
| 449860 | 9/1927 | Fed. Rep. of Germany . | |
| 459543 | 5/1928 | Fed. Rep. of Germany . | |
| 970906 | 11/1958 | Fed. Rep. of Germany | 72/408 |
| 414995 | 3/1910 | France . | |
| 444477 | 5/1912 | France . | |
| 17687 | 5/1913 | France . | |
| 767493 | 2/1957 | United Kingdom | 10/49 |

*Primary Examiner*—Lowell A. Larson
*Assistant Examiner*—Thomas C. Schoeffler
*Attorney, Agent, or Firm*—Wigman & Cohen

[57] ABSTRACT

Apparatus for clamping and working wire pieces has two separate rotary shafts (16) of the clamping levers (18 and 20), arranged symmetrically and with the axis of intake of the wire (82) and the direction of upsetting or hammering at right angles to the axes of rotation of the levers and to the axis of the cam shaft (34), the said direction (82) intersecting the said shaft (34) and passing centrally between the two rotary shafts (16), and on the other hand in directly controlling the clamping levers (18 and 20) by frictional connection rising one or more than one cam (32) on the cam shaft (34) and one cam roller (30) for each cam, the said roller (30) being situated on the lever arm (26 or 38) remote from the tools, the frictional connection being provided by a frictional connection maintaining device (54) which keeps the roller (30) in contact with the cam (32).

2 Claims, 2 Drawing Sheets

APPARATUS FOR THE WORKING OF WIRE PIECES AND THE USE OF SUCH APPARATUS

CROSS REFERENCES TO RELATED APPLICATIONS

This application is subject matter related to commonly assigned copending U.S. application Ser. No. (not yet assigned) filed June 8, 1990 for "Conveyor Device for Transporting Elongated Workpieces such as Wire Pieces and the Use of Such a Device in a Wire Working Nail Press"; copending U.S. application Ser. No. (not yet assigned) filed June 8, 1990 for "Upsetting Device for Upsetting the Ends of Elongated Workpieces such as Wire Pieces and Use of such a Device in a Wire-Working Nail Press"; and U.S. application filed concurrently herewith for "Positioning Device for Arranging Elongated Workpieces and the Use of such a Device in a Wire-Working Machine".

BACKGROUND OF THE INVENTION

1. Field of the Invention

This invention relates to a device for the clamping and working of workpieces and more particularly to such a device for the temporary clamping of wire workpieces for upsetting or hammering the wire workpieces.

2. Definition

When the term "working" is used herein it is intended to include such mechanical forming processes as hammering and upsetting.

Description of the Prior Art

Various machines for the production of wire nails are known, e.g., from DE-PS 449 860 and DE-PS 459 543. In the device according to DE-PS 449 860, the two clamping jaws are mounted in a pair of one-armed levers whose common pivotal axis is at right angles to the axis of the wire and intersects the latter axis. In the device disclosed in DE-PS 459 543, the two clamping jaws are mounted in two two-armed levers whose common pivotal axis extends laterally and parallel to the axis of the wire.

In both these known processes, the clamping force with which the wire is kept fixed in position during the process of upsetting the head is produced by the cam shaft and reinforced by additional links which form a toggle lever.

Apart from the complicated construction of these devices with their many joints and pivots which result in large bearing clearances and are therefore subject to excessive wear and noisy in operation, there is the added risk of breakage if the toggle lever is not correctly adjusted.

SUMMARY AND OBJECTS OF THE INVENTION

It is therefore an object of the present invention to design and arrange the levers carrying the clamping jaws of the clamping device, in particular of an apparatus for the manufacture of wire nails, in such a manner that the closing force of the clamping jaws is increased during the process of upsetting the nail head as the upsetting force increases without additional parts being required for this purpose and at the same time the stress on the cam mechanism of the device is decreased. The knowledge contained herein forms part of the invention.

Proceeding from a device of the type mentioned above, the invention solves this problem by means of two two-armed pivot levers. Owing to the fact that each of the two-armed levers has its own pivotal shafts and these two shafts are arranged one above the other, one above and one below the axis of the wire and at equal distances therefrom, so that the projection of the axis of the nail is also the axis of symmetry of the lever arrangement and passes perpendicularly through the central axis of the cam shaft, the advantageous result is achieved that the upsetting force not only upholds the clamping force but even reinforces it. The pivots of the two levers are arranged to be at such a distance apart that, firstly, a sufficiently large opening angle of the clamping jaws is obtained for a minimum stroke of the radial cams and, secondly, the form of the levers and their bearings is designed to ensure a sufficient closing moment during the process of upsetting of the head so as to relieve the load on the cam shaft. This means that as the upsetting force of the upsetting device increases, so the closing force of the clamping jaws of the clamping device also continuously increases while the force with which the cam rollers press against the cam mechanism for operating the levers of the clamping device decreases. The closing force of the clamping device need only be large enough to ensure that the wire will not shift in the clamping jaws at the onset of the upsetting operation, i.e., when the upsetting tool encounters the end of the wire, since the clamping action is assisted or increased during the process of formation of the head when the upsetting pressure subsequently builds up. The cam shaft for the clamping device and its bearings therefore need only take up a minimum amount of force. The upsetting pressure is taken up by the machine frame by way of the lever bearings.

The present invention also relates to the use of the clamping or upsetting or hammering device according to the invention in a wire-working machine, in particular a nail press used as an apparatus for the manufacture of wire nails, in particular headed nails.

BRIEF DESCRIPTION OF THE DRAWINGS

The invention is described in detail below with reference to a preferred embodiment of the device according to the invention illustrated in the drawings, in which.

DETAILED DESCRIPTION OF THE PREFERRED EMBODIMENTS

Figure 2:
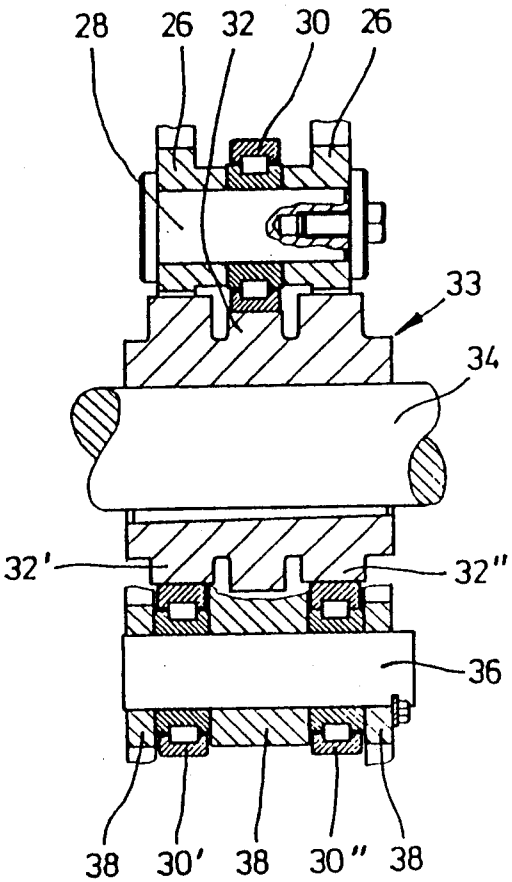
FIG. 2 is a sectional view taken on the line II—II of FIG. 1.
Figure 1:
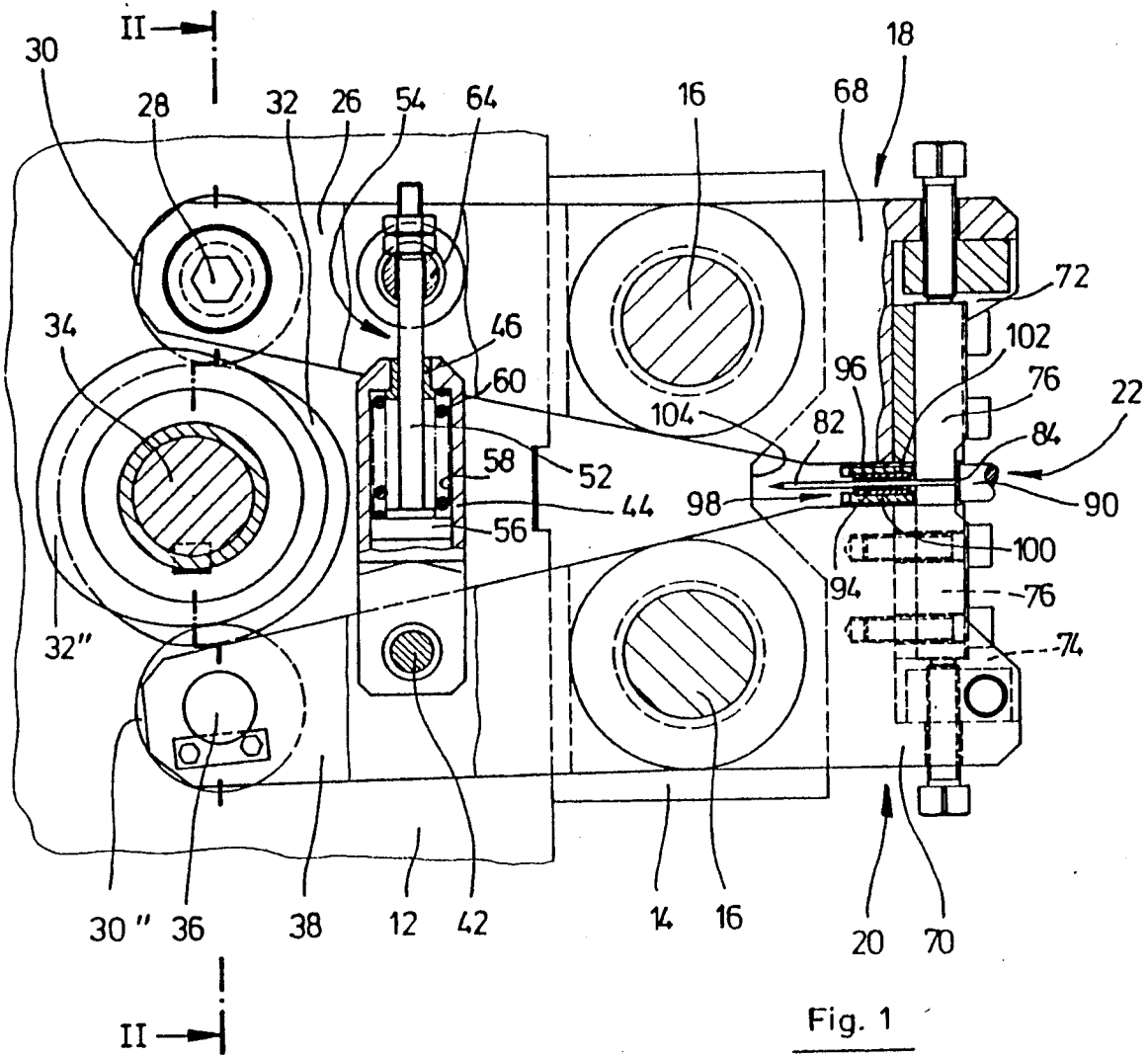
FIG. 1 is a sectional front view of the embodiment, partly broken away.

In FIG. 1, two bearings (14) arranged horizontally one behind the other at some distance apart are fixed in the machine frame (12) by tongue-and-groove joints and two pins (16) placed vertically one above the other are rotatably mounted therein. Between the bearings (14) there are arranged an upper (18) and a lower (20) two-armed lever of the clamping device (22) of an apparatus for the manufacture of wire nails. Each lever (18 and 20) is fixed in its rotation to its pin (16) by a key (not shown). A cam roller (30) is mounted on a pin (28) on the forked, positively moved arm (26) of the upper lever (18) and cooperates with a radial cam (32) while two cam rollers (30′ and 30″) mounted on a pin (36) on the positively moved forked arm (38) of the lower lever

(20) cooperate with two radial cams (32' and 32") which are arranged symmetrically on either side of the axis of symmetry passing through the middle cam (32). All three cams have the same contour so that the two levers (18 and 20) execute identical movements. The three cams (32, 32' and 32") are combined on a cam holder (33) which is fixed in its rotation on a cam shaft (34) which in turn is mounted in ball bearings in the machine frame (12) and is driven by the drive shaft of the apparatus by way of a toothed belt drive.

Between the pin (36) and the associated pin (16), another pin (42) of the lower lever (20) and holds the lower end of a spring cage (44). The rod (52) of a spring plunger (56) is slidably supported in a sleeve (46) of the spring cage (44) while the spring plunger (56) is guided in the bore (58) of the spring cage (44). A compression spring (60) is inserted between the plunger (56) and the base of the bore (58). The threaded end of the rod (52) of the spring plunger (56) passes through the bore of a pin (64) which is rotatably mounted in the arm (26) of the upper lever (18) in a position between the associated pin (16) and the pin (28). The bias tension of the compression spring (60) can be adjusted by means of two nuts seated on the thread of the rod (52), whereby the magnitude of the frictional connection between the cam rollers (30, 30' and 30") and the cams (32, 32' and 32") can be altered. The whole arrangement thus functions as a device (54) for maintaining the frictional connection.

The free ends of the short arms (68 and 70) of the two-armed levers (18 and 20) carry each a tool holder (72 and 74, respectively) in which identical clamping jaws (76) for clamping a wire piece or an unfinished wire nail are fixed by gripping bars (78) and adjustable by means of screws. FIG. 1 shows a wire nail (82) with upset head (84) firmly clamped between the two clamping jaws (76).

FIG. 1 also shows, as part of the apparatus for producing wire nails, the heading tool (90) of an upsetting device for forming the head (84) on the nail blank (86). This heading tool (90) is arranged centrally in front of the two clamping jaws (76).

The shank of the wire nail (83) projecting from the clamping jaws in FIG. 1 is firmly gripped in the gaps between the teeth of two toothed belts (94 and 96) of a conveyor device (98) which forms part of the apparatus for producing wire nails. By means of this conveyor device (98), the nail blanks (86) which are still without a head (84) are intermittently moved towards and away from a position which is exactly central between the clamping jaws (76) of the clamping device (22) in both the horizontal and the vertical plane and in front of the heading tool (90) of the upsetting device. This displacement is effected by the two conveyor belts (94 and 96) moving stepwise transversely to the direction of upsetting and the direction of clamping of the upsetting and clamping devices (90, 76). The distance between the toothed belts (94 and 96) and hence the tension with which the nail blanks (86) are held in the gaps between the teeth can be adjusted by means of a height adjustable guide rail (100 and 102, respectively) on each side. Further, lateral supporting surfaces on the guide rails (100 and 102) guide the toothed belts (94 and 96) ove the conveyor path in such a manner that they cannot be displaced sideways. The bearings (14) have a trapezoidal recess (104) to enable relatively long nails to be transported.

Figure 3:
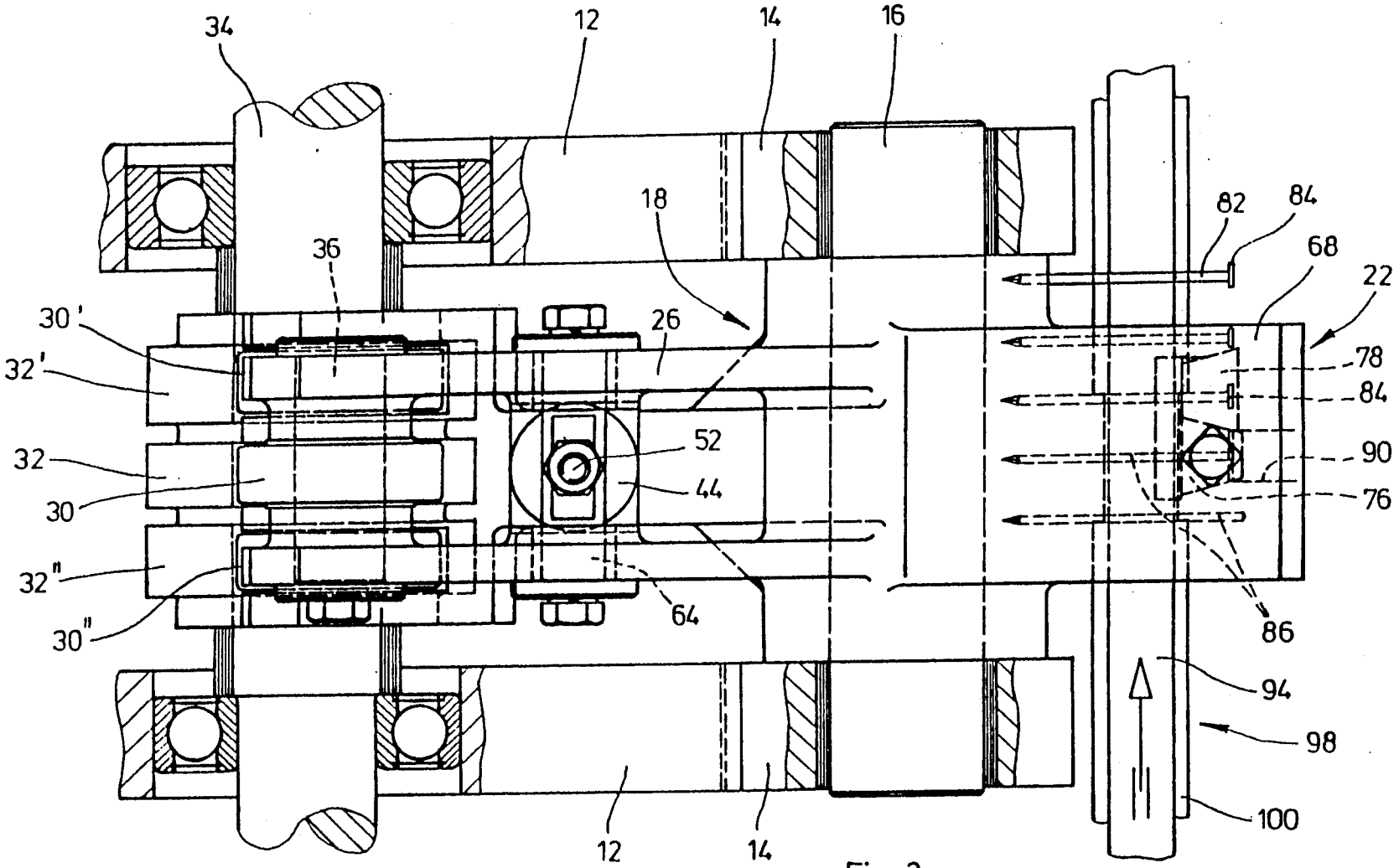
FIG. 3 is a top plan view of the embodiment shown in section and partly broken away.

As shown in FIGS. 1 and 3, there is complete symmetry in the formation and arrangement of the two clamping levers (18 and 20) with respect to a horizontal plane containing the axis of the cam shaft (34) and the axis of the clamped wire nail (82) which intersects the axis of said cam shaft at right angles. Further, the axes of the pins (28, 36 and 16) and the direction of movement of the conveyor device of the toothed belts (94 and 96) in the region of the clamping device (22) extend parallel to the said horizontal plane. Moving in this plane of symmetry and, respectively, transversely thereto, are firstly, the heading tool (90), which moves in a direction perpendicular to the direction of transport of the conveyor device, and, secondly, the clamping jaws (76), which approach each other from opposite directions along a line perpendicular to the axis of the nail to perform their gripping action.

The apparatus described above operates as follows: A take-in device known per se but not shown here takes the wire off a wire supply to pass it through a straightening device and pushes only so much wire through the open cutting tools of a cutting device (not shown) of the apparatus for producing wire nails and into the gaps between the teeth of the two toothed belts (94 and 96) as is necessary for the desired length of the shank of a nail and for forming the head (84) of the nail. The cutting tools then sever the wire and form a pyramidal tip to the wire nail. During the process of inserting the wire between the two toothed belts (94 and 96) and cutting off the wire, the intermittent drive for the pair of toothed belts is briefly at a standstill. Thereafter, the drive is switched on for a short time and the pair of toothed belts is moved onwards by one step and is then again stopped for a fresh intake of wire. This process is repeated until a measured length of nail blank (86) lies between the two clamping jaws (76) of the clamping device (22) and centrally in front of the heading tool (90) with a length of wire projecting from the as yet open clamping jaws exactly equal to the length required for forming the head (84) of the nail. The cam shaft (34) then executes a revolution and the previously open clamping jaws (76) of the clamping device (22), controlled by the radial ascent of the cams (32, 32' and 32"), are closed up by the spreading apart of the long lever arms (26 and 38) of the two-armed levers (18 and 20) and hold the nail blank (86) in position for the upsetting process which then follows for forming the head (84) of the nail. For this upsetting process, the heading tool (90) of the upsetting device is reciprocated, e.g., by a short-stroke crank pin of the drive shaft of the apparatus for producing wire nails. When the head (84) has been formed by the upsetting action produced by the forward movement of the heading tool (90), for which the clamping jaws (76) serve as anvil, the cams (32, 32' and 32") pass through their descending phase. When this occurs, the previously compressed compression spring (60) expands and presses the spring plunger (56) downwards so that the cam rollers (30, 30' and 30") constantly remain in frictional contact with the cams (32, 32' and 32") and the lever arms (26 and 38) move towards one another so that the two clamping jaws (76) open again. At the same time, the heading tool (90) is moved into its rearward position. During the next forward step of the conveyor device (98), the completed wire nail (82) is moved out of the range of the tools while a fresh nail blank (86) arrives between the tools (76 and 90), whereupon the process begins again from the beginning. After a few further transport phases, the completed nails are discharged by dropping onto a chute at the end of the transport path.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An apparatus for clamping and working an elongated wire workpiece, comprising:

two two-armed clamping levers on each of which is mounted a clamping tool cooperating with the other clamping tool for gripping the workpiece;

a cam mechanism having a cam shaft, at least one control cam, and cooperating cam rollers for moving the clamping levers for alternately opening and closing the two clamping tools;

said cam mechanism comprising an arrangement of two outer cam discs and an inner cam disc disposed therebetween, and each said disc having a periphery and commonly mounted on said cam shaft, and three cam rollers, of which two are mounted on the same clamping lever while the third cam roller is mounted on the other clamping lever in a first plane of symmetry determined by and disposed between said two cam rollers and by said two outer cam discs;

a working tool which encounters the workpiece to be worked in a particular straight direction;

said cam shaft having an axis and said two clamping levers being symmetrically formed so as to lie on both sides of a second plane of symmetry, having separate, parallel rotary shafts having axes parallel to said cam shaft axis, the direction of encounter of the working tool upon the workpiece crossing centrally between both said rotary shafts and at right angles thereto and intersecting the axis of said cam shaft at a right angle, the said particular straight direction of the encounter lying in said second plane of symmetry; and in that said cam shaft directly controls said two clamping levers by frictional connection between said cam rollers and the peripheries of said cam discs encircling said cam shaft, thereby eliminating bending moments on said cam shaft; and means for maintaining said frictional connection keeping said cam rollers mounted on the clamping lever arms remote from said clamping tools in contact with said cam discs.

2. An apparatus according o claim 1, wherein said frictional connection maintaining means comprises a device common to both said clamping levers, which device connects said arms of said two clamping levers and includes a plunger attached to a rod and operated by a spring, said plunger contained in a cylinder, said rod mounted rotatably on one clamping arm, and said cylinder rotatably mounted to the other clamping arm, said device setting a bias tension of said spring in said cylinder on said plunger.

* * * * *